US005497909A

United States Patent [19]

Wirsig et al.

[11] Patent Number: 5,497,909

[45] Date of Patent: Mar. 12, 1996

[54] REUSEABLE POUCH FITMENT

[75] Inventors: Ralph C. Wirsig; John R. Thompson, both of Kingston, Canada

[73] Assignee: Du Pont Canada Inc., Mississauga, Canada

[21] Appl. No.: 140,030

[22] PCT Filed: Apr. 10, 1992

[86] PCT No.: PCT/CA92/00150

§ 371 Date: May 12, 1994

§ 102(e) Date: May 12, 1994

[87] PCT Pub. No.: WO92/19528

PCT Pub. Date: Nov. 12, 1992

[30] Foreign Application Priority Data

Apr. 29, 1991 [GB] United Kingdom ..... 9109168

[51] Int. Cl.[6] ..... B67D 5/00

[52] U.S. Cl. ..... 222/82; 222/83; 222/383.1; 222/105

[58] Field of Search ..... 222/80–89, 94, 222/105, 400.8, 400.7, 383.1

[56] References Cited

U.S. PATENT DOCUMENTS

| | | | |
|---|---|---|---|
| 2,161,049 | 6/1939 | Horstman | 222/82 |
| 2,598,843 | 9/1947 | Sherwood | 222/83 |
| 2,954,144 | 9/1960 | Eliam et al. | 222/82 |
| 3,035,737 | 5/1962 | Speas | 222/82 X |
| 3,193,145 | 7/1965 | Vara, Sr. | 222/82 |
| 3,208,639 | 9/1965 | Marwell et al. | 222/82 |
| 3,374,927 | 3/1968 | Schmidt | 222/82 |
| 3,705,666 | 12/1972 | Nelson et al. | 222/82 |
| 4,265,372 | 5/1981 | Wainberg | 222/82 |
| 4,493,438 | 1/1985 | Rutter | 222/83 |
| 4,567,999 | 2/1986 | Hjertman et al. | 222/83 |
| 4,637,934 | 1/1987 | White | 222/83 X |
| 4,706,827 | 11/1987 | Cabernoch et al. | 222/83 X |
| 4,828,147 | 5/1989 | Wiedmann et al. | 222/82 |
| 4,854,760 | 8/1989 | Pike et al. | 222/83 X |
| 5,031,798 | 7/1991 | Wild | 222/82 |
| 5,127,550 | 7/1992 | Knorr | 222/83 |
| 5,141,134 | 8/1992 | Machado | 222/83.5 |
| 5,330,076 | 7/1994 | Tsuruta | 222/83 |

FOREIGN PATENT DOCUMENTS

| | | | |
|---|---|---|---|
| 1192164 | 8/1985 | Canada | 210/19 |
| 0410770 | 10/1993 | European Pat. Off. . | |
| 1027817 | 6/1967 | United Kingdom . | |
| 2117745 | 10/1983 | United Kingdom . | |
| WO91/17110 | 11/1991 | WIPO . | |

*Primary Examiner*—Kevin P. Shaver
*Attorney, Agent, or Firm*—Peter A. Fowell

[57] ABSTRACT

A reuseable gasketless spout adaptable to conversion to a pump dispenser for fluid contained in a pouch made of inextensible film, comprises a spout-tube and a plunger with a conical tip, the plunger movable coaxially within the spout-tube. The spout is inserted into the pouch, its plunger first puncturing the pouch film, and the edges of the opening produced surround and form a gasketless seal with the outside wall of the spout-tube when the spout is fully inserted. The spout, after full insertion into the pouch, may be converted into a pump dispenser for fluid in the pouch by removing the plunger and replacing it with a pump which has a supply-tube extending coaxially through the spout-tube, into the fluid within the pouch. The dispenser, having the spout-tube in common with the spout is, like the spout, reuseable.

12 Claims, 3 Drawing Sheets

REUSEABLE POUCH FITMENT

BACKGROUND OF THE INVENTION

1. Field of the Invention

The present invention relates to an improved piercing nozzle for pouch fitments, which are used to control the removal of the contents of filled thermoplastic polymeric film pouches, particularly pouches which contain about 500 ml or more.

2. Description of Related Art

As is known, the use of plastic pouches is common with respect to packaging certain liquids and other fluid materials, e.g. milk, fruit juices, relish and the like. For example, milk has been sold in pouches from 250 ml up to about 1.9 liters. The plastic pouches are often made of polyethylene film. In order to remove the contents from the pouch, a simple method of cutting one of the corners, for example with scissors, has sufficed for many end uses, in the home. However, with institutional purchasers such as restaurants, which purchase and use pouches containing relishes, mustard, chocolate sauces and the like, it is inconvenient to use scissors and also the snipped-off corner may contaminate the material after it has been poured or squeezed from the pouch.

Particularly for institutional purchasers, therefore, it is desirable that the pouch has a pouring spout, preferably one that can be resealed. It is known to incorporate pouring spouts into plastic pouches but this is expensive because of the need for one pouring spout per pouch. It would be economically more desirable if the spout was able to be inserted into the pouch and used until the pouch was empty, and then be removed and cleaned for re-use with another pouch.

One such pouring spout is disclosed in Canadian Patent 1 192 164 to L. Obidniak. In L. Obidniak's configuration, the pouring spout comprises an elongated body, one of the ends being pointed and the other being integrally prolonged by a threaded stem. A passage is provided for flow of liquid from the pouch. The disclosure of L. Obidniak indicates that the passage is preferably T-shaped. The T-shaped passage is ineffective for removing thick materials which include particulates therein, for example relish, from the pouch.

Another pouring spout, used for application to the side of a rigid paper carton, is disclosed in U.S. Pat. No. 2,598,843 to F. D. Sherwood, which issued 1952 Jun. 3.

A further pouring spout is disclosed in European Publication 0410 770 to R. P. Harrison and R. C. Wirsig, published 1991 Jan. 30. The disclosed spout comprises a tube having a piercing portion separated from a delivery portion by a film securement portion and having fluid flow communication from the piercing portion to the delivery portion. The film securement portion is adapted to secure, with a substantially liquid-tight seal, plastic film which has been pierced by the piercing portion. The piercing portion appears, in one perspective, to have been sliced at an angle to the longitudinal axis from a first location at one side of the tube adjacent the film securement portion to a second location at the other side of the tube, distal from the film securement portion, to form a tip. The tip appears, in a second perspective at 90° to the first perspective, to have been sliced symmetrically about the longitudinal axis of the tube to from a pointed piercing tip furthest away from the film securement portion.

Particularly for institutional purchasers it is also useful that the pouches are contained in a dispenser for ease of handling. One such dispenser comprises i) a cylindrical container having sides and an open top having a rim, the container being adapted to contain the pouch, and ii) a lid attachable to the rim such that the lid is adapted to trap the ears of the pouch between the lid and the rim and to keep said end of the pouch taut between the ears when the lid is attached to the rim. The lid is also adapted to allow a spout to pierce the pouch at the taut portion. Such a dispenser and spouts therefor are disclosed in U.K. Patent Application 90.09846 filed 1990 May 2 to D. C. King and R. C. Wirsig.

When the piercing portions of the some of the spouts disclosed in European Patent Publication 0410 770 and U.K. Patent Application 90.09846 are worked into taut film there is a tendency for the piercing tip, after the initial point entry through the film, to "plough" its way into the film. The initial point entry is at or near the edge of the eventual opening in the film and the "ploughing" action is from the initial entry point, which is on one side of the eventual opening, over to the other side of the opening. This usually leads to film tearing at the edge of the film opening and thus may cause leakage of material from the pouch. With the nozzle in FIG. 9 of U.K. Patent Application 90.09846, puncturing and opening of the film depends on a die cutting action by the serrated edges to make the initial opening in the film. This initial opening is stretched only slightly before a seal is attempted. In the case of relatively non-stretchy films, which are typically also difficult to cut through, such nozzles tend to cause tearing of the film, thus making sealing difficult. Even if the cut-through is clean, i.e. no edge tearing, the amount of stretch given to the film is often insufficient to effect a good seal. The type of spout disclosed in the aforementioned Canadian Patent assists in overcoming the leakage problem just mentioned but suffers from the fact that the T-shaped passage does not allow "lumpy" materials to flow easily through the bore of the spout.

It is believed that the keys to obtaining a good seal around a tubular spout, when used with a relatively non-stretchy film are to insert the spout by making the initial puncture in the film small and in the center of the eventual opening, and then ploughing the opening evenly in all directions from the initial puncture. It is also believed that to so insert the spout, tearing of the film around the opening is minimized, thus making sealing easier.

SUMMARY OF THE INVENTION

The present invention endeavours to provide a spout which is easily inserted into a plastic pouch, in which the film at the point of entry is kept taut, and which spout is adapted to allow removal of a wide variety of materials from such pouch.

Accordingly the present invention provides a spout, for insertion into a plastic pouch, said spout having a film-puncturing end comprising a tube and a removable plunger adapted to move coaxially inside the tube, an end of said plunger being conical and adapted to puncture film and expand an opening resulting from the puncture in a manner to lead the edges of the opening over said tube, said tube also being adapted to permit said edges of the opening to move over said conical portion and thence over the outer periphery of said tube.

In one embodiment, the end of the tube adjacent the conical portion has a wall tapering from being thick adjacent the film securement portion to thin furthest away from the film securement portion.

In another embodiment the tube has a film securement portion adapted to secure the edges of the film opening.

In a further embodiment the angle of the conical portion is from 25° to 65° relative to the longitudinal axis of the plunger.

In yet another embodiment the angle at the tip of the conical portion is from 55° to 65° relative to the longitudinal axis of the plunger, changing to from 25° to 35° further from said tip.

In a further embodiment the internal diameter of the tube is from 10 to 30 mm.

In another aspect of the invention a spout is inserted into a pouch made with a substantially inextensible film, said spout having a film-puncturing end comprising a tube and a removable plunger adapted to move coaxially inside the tube, an end of said plunger being conical and adapted to puncture film and expand an opening resulting from the puncture in a manner to lead the edges of the opening over said tube, said tube also being adapted to permit said edges of the opening to move over said conical portion and thence over the outer periphery of said tube, by keeping the film taut at a point of entry of the conical portion of the plunger, pushing the conical portion through the film such that the edges of the opening move over-the outer periphery of the tube.

BRIEF DESCRIPTION OF THE DRAWINGS

Embodiments of the invention are now described with reference to the drawings in which.

DESCRIPTION OF THE PREFERRED EMBODIMENTS

Figure 1:
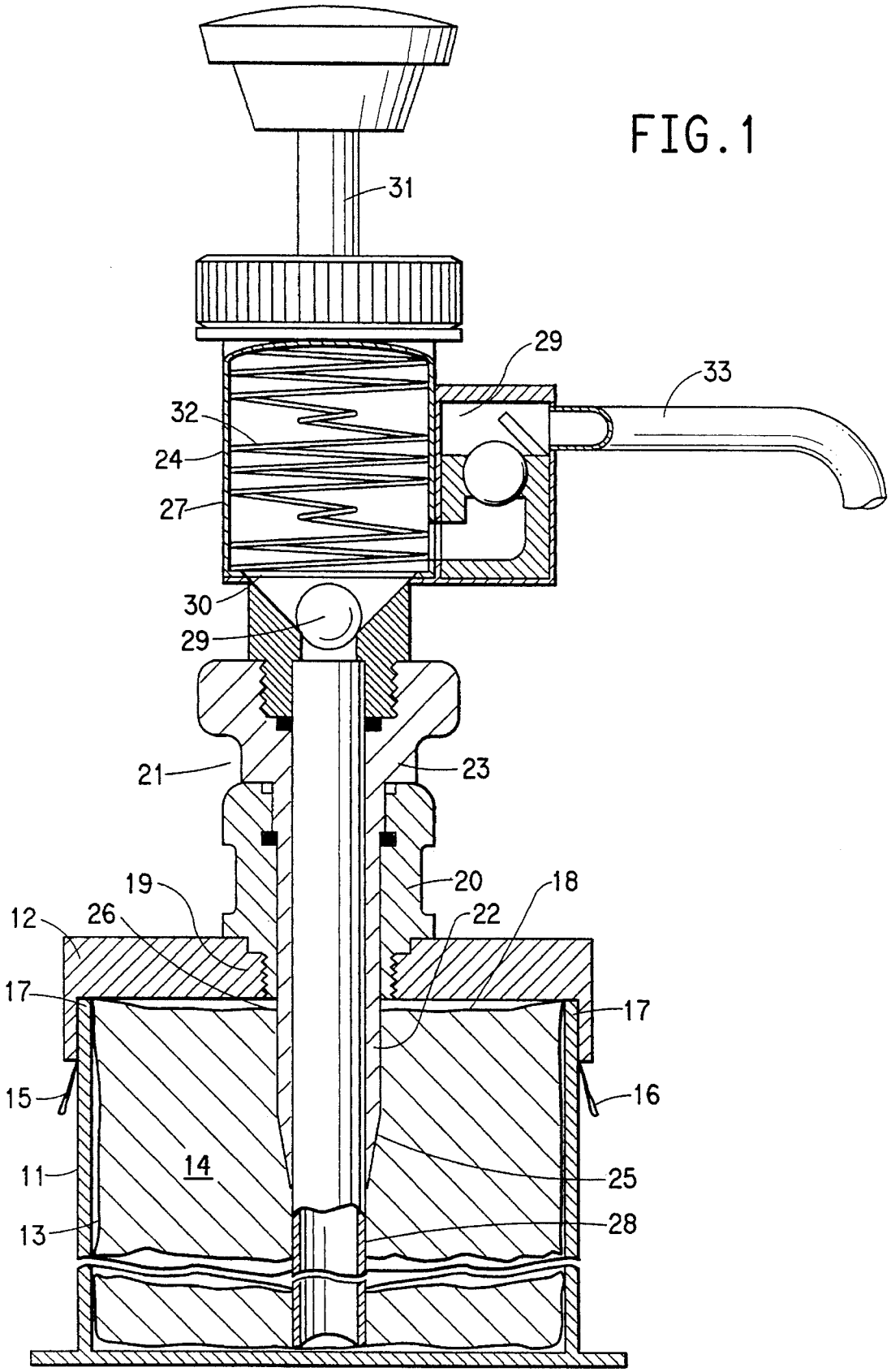
FIG. 1 is a cross-sectional view of a pump dispenser with a spout of the present invention.

FIG. 1 shows a container 11 which has a lid 12 attached thereto. Inside the container is a pouch 13 containing material 14 such as mustard. The pouch is gripped by ears 15 and 16 at the rim of the container 17 by trapping the ears between the rim 17 and the lid 12. The top of the pouch 18 is thereby held taut because of entrapment of ears 15 and 16. In the embodiment shown the pouch is made from a thermoplastic polymeric film which is relatively inextensible, e.g. a laminate of polyethylene and ethylene/vinyl alcohol films. Inserted into an orifice 19 in the lid 12 is a sleeve 20 which is secured to lid 12. Inserted through sleeve 20 and coaxial therewith is spout 21 which comprises tube 22 and boss 23. Boss 23 serves the function of securing spout 21 to sleeve 20 and permitting attachment of pump 24. Tube 22 extends through lid 12, through the top 18 of the pouch and into the body of container 11. Tube 22 is chamfered at its tip 25 as will be described more fully in relation to FIGS. 2 and 3. Film surrounding a puncture 26 in the film forms a seal around tube 22. Attached to boss 23 is pump 24 which comprises a body 27, tube 28, one-way valves 29, piston 30 with associated plunger 31 and return spring 32, and outlet 33.

Figure 2:
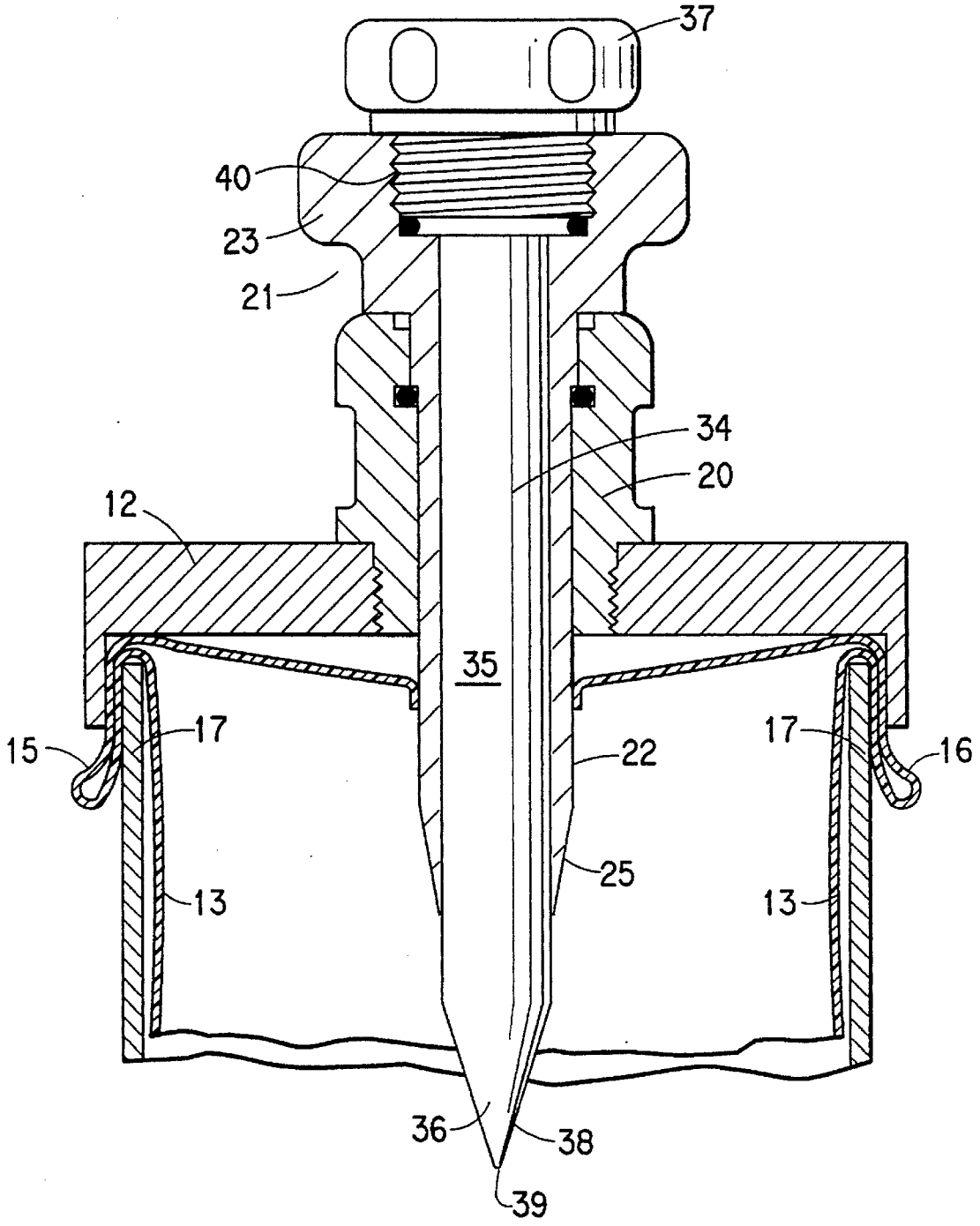
FIG. 2 is a cross-sectional view of a spout and puncturing device of the present invention.

FIG. 2 shows part of the dispenser prior to attachment of pump 24. Sleeve 20 is inserted into lid 12 and spout 21 is inserted into sleeve 20. Lid 12, sleeve 20, boss 23 and pump 24 may each be held in place by, for example, twist and locking lugs, screw threads or the like. In the drawings, screw threads are shown. Spout 21 comprises tube 22 and boss 23. Inserted through the bore of tube 22, and coaxial therewith is plunger 34. Plunger 34 comprises rod 35 having a conical tip 36 at one end and knob 37 at the other. The major portion 38 of conical tip 36 is tapered at about the same angle as chamfered portion 25 of tube 22. A typical angle is about 15° relative to the longitudinal axis of tube 22. The end 39 of conical tip 36 may be blunted or tapered at an angle greater than the angle of portion 38. A typical angle is 30° relative to the longitudinal axis of tube 22. Plunger 34 is threadably or otherwise attached, in a detachable manner, to boss 23, e.g. using threads 40.

Figure 3:
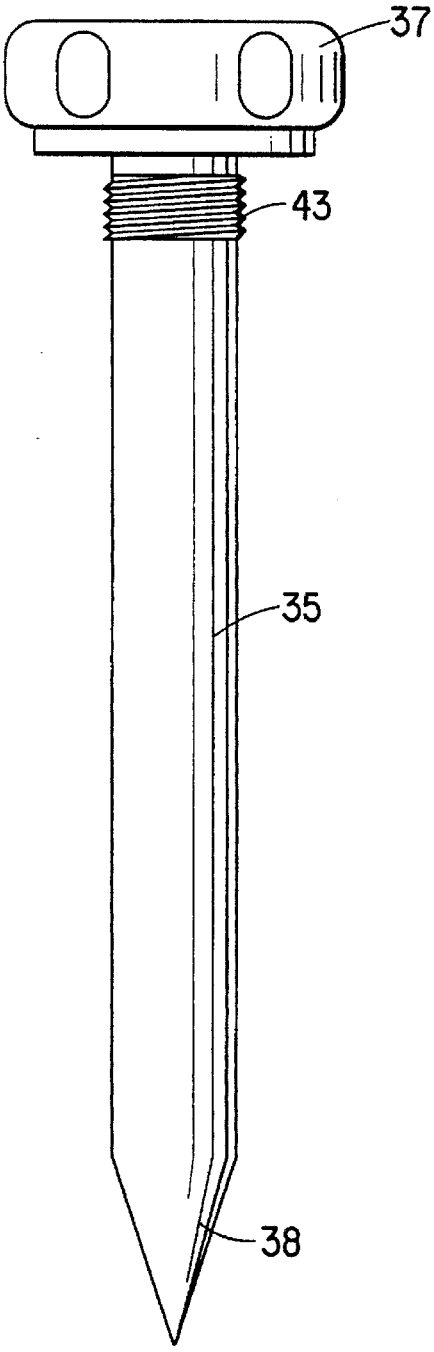
FIGS. 3 is a side elevation and FIG. 4 is a cross-section, which show two portions of the spout and piercing device of FIG. 1.
Figure 4:
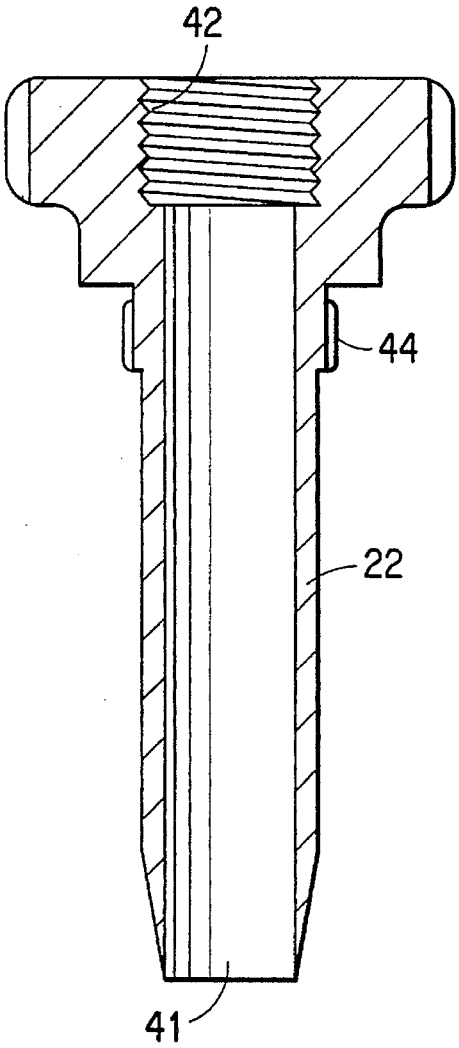

FIGS. 3 and 4 show spout 21 and plunger 34 in more detail. Spout 21 comprises tube 22, having a bore 41, and boss 23. Boss 23 has a threaded portion 42 in the bore thereof, which is adapted to receive threads 43 of plunger 34, shown in FIG. 4. Boss 23 may be attached to sleeve 20 by threads 44. Plunger 34 comprises rod 35 which is attached to knob 37. The end of rod 35 distal to knob 37 has a conical tip 38. Threads 43 are close to knob 37.

In operation, pouch 13 is placed in container 11 and the ears 15 and 16 held across the rim of container 11 so that the top 18 of pouch 13 is taut. While the ears 15 and 16 are held manually, the lid 12 is closed over the ears and secured to the rim of container 11 by a snap closure or the like, thus trapping ears 15 and 16. Lid 12 has sleeve 20 attached thereto. Spout 21 is assembled by inserting plunger 34 through the bore of tube 22 and the plunger is secured to boss 23 by means of threads 40 or similar. This assembly of spout 21 and plunger 34 is then inserted into the bore of sleeve 20 and pushed so that end 39 of conical tip 38 punctures the film of the top 18 of pouch 13. Because the outer diameter of spout 21 slides against the inside diameter of sleeve 20 before the plunger tip 39 contacts the top film, it is assured that the initial puncture into the film is in the center of the eventual opening in the film. Spout 21 is pushed further and conical portion 38 causes the puncture in the film to widen and conform to the shape of the periphery of conical portion 38. As spout 21 is pushed even further the film opening rides over chamfered portion 25 and the outside of tube 22. It has been found that with relatively nonstretchy films, there is a sufficient seal between the film and tube 22 for use in pump dispensers. Boss 23 is locked onto sleeve 20 with threads, a twist and lock feature or similar. Plunger 34 is unscrewed and removed from the bore of tube 22. Tube 22 then permits the introduction of tube 28 of pump 24. Pump 24 also has a threaded portion which is adapted to engage in the threads 42 of boss 23. After engagement, material 14 in pouch 13 may be pumped out of pouch 13. The advantage of the method for puncturing the film is that the aperture in the film is opened evenly in all directions from the initial puncture point, which minimizes tearing and maximizes stretch retention and snugness of fit around tube 22. As will be appreciated this type of seal in unsuitable for applications where the contents of the pouch are put under pressure as, for example, with a dispenser "gun" as disclosed in European Publication 0410 770.

We claim:

1. A device for puncturing a sealed plastic pouch containing flowable material, said pouch having a pair of spaced ears at one end of said pouch comprising:

(a) a container having an open end defining a rim and adapted for holding said pouch;

(b) a lid releasably securable to said rim so as to trap said ears of said pouch between said lid and said rim and present a taut portion of said pouch between said ears when said lid is secured to said rim;

(c) a hollow tube slidably moveable relative to said lid, said tube including a first end disposed inwardly of said lid and a second end disposed outwardly of said lid, said first end presenting a circumferential chamfer;

(d) a plunger removably securable to and slidably locatable within said hollow tube, said plunger including a substantially conical first end disposed inwardly of said lid, said hollow tube and said plunger slidably moveable together relative said lid from a first position spaced from said taut portion of said pouch to a second position puncturing said taut portion of said pouch to form a seal between said punctured portion of said taut portion of said pouch and said tube, said plunger slidably removable from said tube after puncturing of said taut portion of said pouch without leakage of said flowable material from said pouch.

2. A device as claimed in claim 1, wherein said plastic pouch is kept taut between said ears at the point of entry of said conical portion of said plunger.

3. A device as claimed in claim 2 wherein said plunger is slidably removable from said tube without leakage of said flowable material from said pouch to permit entry of a supply tube of a pump into said tube and interior of said pouch.

4. A device as claimed in claim 3 wherein said lid includes a sleeve located substantially centrally with respect thereto for receiving said tube.

5. A device as claimed in claim 4 wherein said plunger includes a second threaded end for threadable engagement of said hollow tube.

6. A device as claimed in claim 5 wherein said conical end has a taper of about 25° to 65°.

7. A device as claimed in claim 6 wherein said chamfer has a taper of an angle less than or equal to the angle of said conical end.

8. A device as claimed in claim 7 wherein said hollow tube is threadably engageable with said pump.

9. A device as claimed in claim 8 wherein slidable removal of said plunger from said hollow tube reveals an unobstructed longitudinal dispensing passage.

10. A reuseable gasketless spout for insertion into a plastic pouch formed from substantially inextensible film, said pouch having flowable material and a taut portion between a pair of spaced ears at one end of said pouch, said spout comprising;

(a) a spout-tube having a first end which remains outside the pouch after insertion of the spout, and a second end which remains inside the pouch after insertion of the spout, both ends being open, and (b) a removable plunger having a rod portion adapted to move coaxially inside the spout-tube, the plunger having a top end and a bottom end, the bottom end having a conical tip contiguous with the rod portion, the plunger being of sufficient length that the conical tip extends below the second end of the spout-tube, the tip adapted to puncture said inextensible film, its conical form having the ability to expand an opening in the film resulting from such a puncture in a manner to lead the edges of the opening to move over the conical tip and thence to the second end of the spout-tube, after which the spout-tube may be inserted into the pouch, the edges of said opening thereby moving up the outer surface of spout-tube forming a gasketless seal around said spout tube.

11. The spout of claim 10 wherein the second end of the spout-tube is chamfered upward from inside to outside, the degree of taper of the chamfer being substantially the same as that of the conical tip of the plunger, so that when the edge of the opening in the inextensible pouch film has expanded and moved up the conical tip as the plunger is inserted into the pouch, the edge can then readily move onto the chamfered end acting as a continuation of the plunger tip, thence to a position around the outside of the non-chamfered portion of the spout-tube to form a gasketless seal.

12. The spout as claimed in claim 11 wherein removal of said plunger from said hollow tube reveals an unobstructed longitudinal dispensing passage.

* * * * *